US010041338B2

(12) United States Patent
Least

(10) Patent No.: US 10,041,338 B2
(45) Date of Patent: Aug. 7, 2018

(54) ADJUSTABLE AUTONOMOUS INFLOW CONTROL DEVICES

(71) Applicant: Halliburton Energy Services, Inc., Houston, TX (US)

(72) Inventor: Brandon Thomas Least, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 1035 days.

(21) Appl. No.: 14/377,521

(22) PCT Filed: Oct. 30, 2013

(86) PCT No.: PCT/US2013/067367
§ 371 (c)(1),
(2) Date: Aug. 8, 2014

(87) PCT Pub. No.: WO2015/065346
PCT Pub. Date: May 7, 2015

(65) Prior Publication Data

US 2015/0337626 A1 Nov. 26, 2015

(51) Int. Cl.
*E21B 34/12* (2006.01)
*E21B 43/12* (2006.01)
(Continued)

(52) U.S. Cl.
CPC ..... *E21B 43/12* (2013.01); *E21B 34/08* (2013.01); *E21B 34/12* (2013.01); *E21B 43/08* (2013.01); *E21B 2034/007* (2013.01)

(58) Field of Classification Search
CPC ..... E21B 43/12; E21B 34/08
See application file for complete search history.

(56) References Cited

U.S. PATENT DOCUMENTS 8,291,976 B2 10/2012 Schultz et al.
2009/0218103 A1 9/2009 Aakre et al.
(Continued)

FOREIGN PATENT DOCUMENTS

WO 2015065346 A1 5/2015

OTHER PUBLICATIONS

International Search Report and Written Opinion for PCT/US2013/67367 dated Jul. 21, 2014.

*Primary Examiner* — Nicole Coy
*Assistant Examiner* — Kristyn A Hall
(74) *Attorney, Agent, or Firm* — McDermott Will & Emery LLP

(57) ABSTRACT

Disclosed are wellbore flow control devices that allow on-site field adjustments to flow characteristics. One disclosed well system includes a base pipe defining one or more flow ports and an interior, a first end ring and a second end ring each arranged about the base pipe, the second end ring being axially-offset from the first end ring such that a fluid compartment is defined therebetween, an autonomous inflow control device (AICD) arranged within the fluid compartment and having at least one fluid inlet and an outlet in fluid communication with the one or more flow ports, and a sleeve removably coupled to the first and second end rings and configured to be removed to provide access to the fluid compartment and the AICD in order to make on-site fluid flow adjustments to the AICD.

24 Claims, 4 Drawing Sheets

(51) Int. Cl.

| | |
|---|---|
| ***E21B 34/08*** | (2006.01) |
| *E21B 34/00* | (2006.01) |
| *E21B 43/08* | (2006.01) |

(56) References Cited

U.S. PATENT DOCUMENTS

| | | | | |
|---|---|---|---|---|
| 2011/0083860 | A1* | 4/2011 | Gano | E21B 43/08<br>166/386 |
| 2011/0186300 | A1* | 8/2011 | Dykstra | E21B 34/08<br>166/316 |
| 2011/0198097 | A1 | 8/2011 | Moen | |
| 2013/0075112 | A1 | 3/2013 | Franklin et al. | |
| 2013/0228341 | A1 | 9/2013 | Fripp et al. | |

* cited by examiner

ADJUSTABLE AUTONOMOUS INFLOW CONTROL DEVICES

BACKGROUND

The present invention generally relates to wellbore flow control devices and, more specifically, to making on-site field adjustments to autonomous inflow control devices.

In hydrocarbon production wells, it is often beneficial to regulate the flow of formation fluids from a subterranean formation into a wellbore penetrating the same. A variety of reasons or purposes can necessitate such regulation including, for example, prevention of water and/or gas coning, minimizing water and/or gas production, minimizing sand production, maximizing oil production, balancing production from various subterranean zones, equalizing pressure among various subterranean zones, and/or the like.

A number of devices are available for regulating the flow of formation fluids. Some of these devices are non-discriminating for different types of formation fluids and can simply function as a "gatekeeper" for regulating access to the interior of a wellbore pipe, such as a well string. Such gatekeeper devices can be simple on/off valves or they can be metered to regulate fluid flow over a continuum of flow rates. Other types of devices for regulating the flow of formation fluids can achieve at least some degree of discrimination between different types of formation fluids. Such devices can include, for example, tubular flow restrictors, nozzle-type flow restrictors, autonomous inflow control devices, non-autonomous inflow control devices, ports, tortuous paths, combinations thereof, and the like.

Autonomous inflow control devices (AICD) can be particularly advantageous in subterranean operations, since they are able to automatically regulate fluid flow without the need for operator control due to their design. In this regard, AICDs can be designed such that they provide a greater resistance to the flow of undesired fluids (e.g., gas and/or water) than they do desired fluids (e.g., oil), particularly as the percentage of the undesired fluids increases.

Several AICDs are often combined into an AICD system that can be manufactured to particular specifications and/or designs requested by well operators based on production needs for particular well sites. Such design specifications may include the required flow rate of fluids through the AICD system for normal operation. Upon receiving the AICD system at a well site, however, production needs for the well operator or a well site may have changed. For instance, the well operator may learn new information about the well which would necessitate an AICD system configured for different production capabilities. Alternatively, the well operator may desire to use the manufactured AICD system at a different well site where the production needs and/or capabilities are different. Accordingly, it may prove advantageous to have an AICD system that is adjustable on-site by the well operator.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present invention generally relates to wellbore flow control devices and, more specifically, to making on-site field adjustments to autonomous inflow control devices.

Disclosed are various ways to restrict fluid flow through an autonomous inflow control device, and thereby allow a well operator to make on-site field adjustments to autonomous inflow control device systems. While on-site, a sleeve associated with the autonomous inflow control device system may be removed to access the autonomous inflow control devices and thereby adjust various features thereof in order to adjust how much fluid flow will be allowed during production operations. In some embodiments, a top plug may be removed from the autonomous inflow control device to enable the well operator to change out autonomous inflow control device nozzles in order to optimize production capabilities. In other embodiments, fluid flow restrictors may be inserted into fluid inlets to the autonomous inflow control device in order to restrict the amount of fluid that is able to enter the autonomous inflow control device. As a result, a well operator may have the ability to strategically adjust fluid flow capabilities of an autonomous inflow control device system in the field.

As used herein, the term "on-site" refers to a rig location or field location where an autonomous inflow control device system or assembly may be delivered and otherwise following its discharge from a manufacturer's facility. The term may also refer to any location that the autonomous inflow control device system might encounter prior to being deployed downhole.

Figure 1:
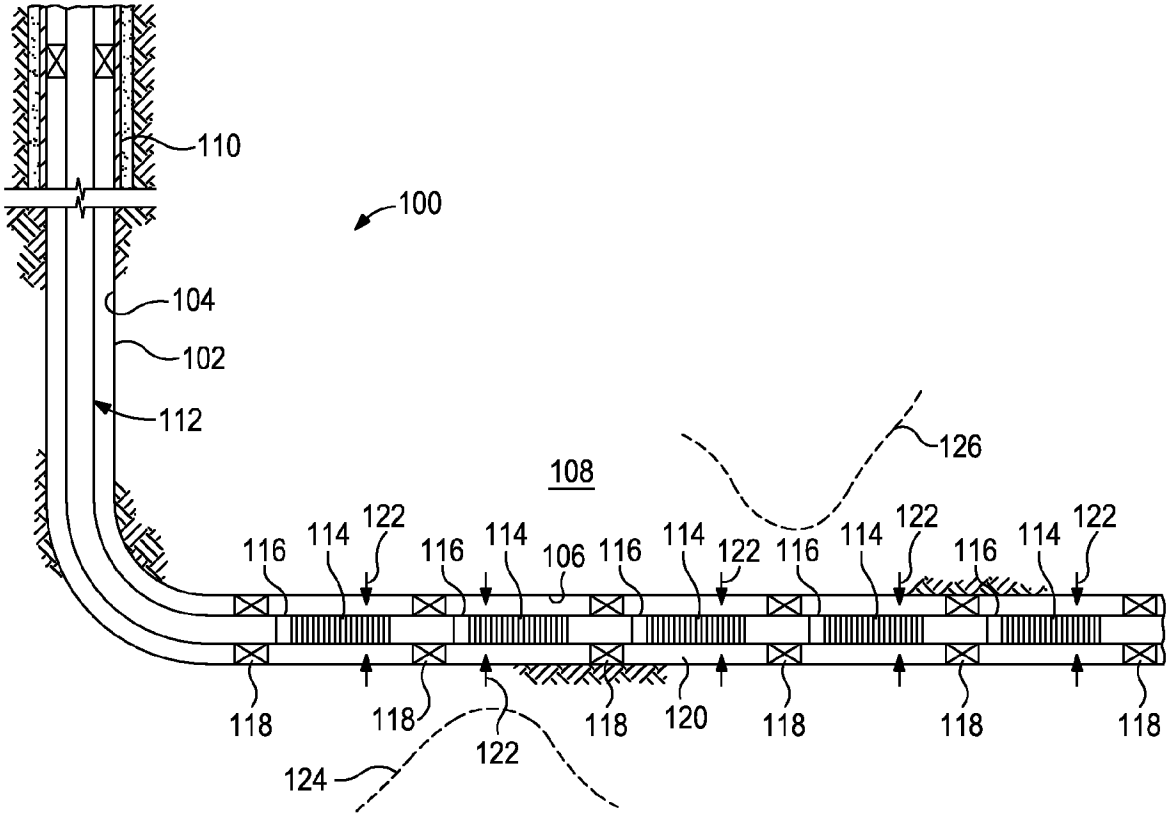
FIG. 1 illustrates a well system which can embody principles of the present disclosure, according to one or more embodiments.

Referring to FIG. 1, illustrated is a well system 100 which can embody principles of the present disclosure, according to one or more embodiments. As illustrated, the well system 100 may include a wellbore 102 that has a generally vertical uncased section 104 that transitions into a generally horizontal uncased section 106 extending through a subterranean earth formation 108. In some embodiments, the vertical section 104 may extend downwardly from a portion of the wellbore 102 having a string of casing 110 cemented therein. A tubular string, such as production tubing 112, may be installed in or otherwise extended into the wellbore 102.

One or more well screens 114, one or more flow control devices 116, and one or more packers 118 may be interconnected along the production tubular 112, such as along portions of the production tubular 112 in the horizontal section 106 of the wellbore 102. The packers 118 may be configured to seal off an annulus 120 defined between the production tubular 112 and the walls of the wellbore 102. As a result, fluids 122 may be produced from multiple intervals or "pay zones" of the surrounding subterranean formation 108 via isolated portions of the annulus 120 between adjacent pairs of the packers 118.

As illustrated, in some embodiments, a well screen 114 and a flow control device 116 may be interconnected in the production tubular 112 and positioned between a pair of packers 118. The well screens 114 may be swell screens, wire wrap screens, mesh screens, sintered screens, expandable screens, pre-packed screens, treating screens, or other known screen types. In operation, the well screen 114 may be configured to filter the fluids 122 flowing into the production tubular 112 from the annulus 120. The flow control device 116 may be configured to restrict or otherwise regulate the flow of the fluids 122 into the production tubular 112, based on certain physical characteristics of the fluids.

It will be appreciated that the well system 100 of FIG. 1 is merely one example of a wide variety of well systems in which the principles of this disclosure can be utilized. Accordingly, it should be clearly understood that the principles of this disclosure are not necessarily limited to any of the details of the depicted well system 100, or the various components thereof, depicted in the drawings or otherwise described herein. For example, it is not necessary in keeping with the principles of this disclosure for the wellbore 102 to include a generally vertical wellbore section 104 or a generally horizontal wellbore section 106. Moreover, it is not necessary for fluids 122 to be only produced from the formation 108 since, in other examples, fluids could be injected into the formation 108, or fluids could be both injected into and produced from the formation 108, without departing from the scope of the disclosure.

Furthermore, it is not necessary that at least one well screen 114 and flow control device 116 be positioned between a pair of packers 118. Nor is it necessary for a single flow control device 116 to be used in conjunction with a single well screen 114. Rather, any number, arrangement and/or combination of such components may be used, without departing from the scope of the disclosure. In some applications, it is not necessary for a flow control device 116 to be used with a corresponding well screen 114. For example, in injection operations, the injected fluid could be flowed through a flow control device 116, without also flowing through a well screen 114.

It is not necessary for the well screens 114, flow control devices 116, packers 118 or any other components of the production tubular 112 to be positioned in uncased sections 104, 106 of the wellbore 102. Rather, any section of the wellbore 102 may be cased or uncased, and any portion of the production tubular 112 may be positioned in an uncased or cased section of the wellbore 102, without departing from the scope of the disclosure.

Those skilled in the art will readily recognize the advantages of being able to regulate the flow of fluids 122 into the production tubular 112 from each zone of the subterranean formation 108, for example, to prevent water coning 124 or gas coning 126 in the formation 108. Other uses for flow regulation in a well include, but are not limited to, balancing production from (or injection into) multiple zones, minimizing production or injection of undesired fluids, maximizing production or injection of desired fluids, etc. The exemplary flow control devices 116, as described in greater detail below, may provide such benefits by increasing resistance to flow if a fluid velocity increases beyond a selected level (e.g., to thereby balance flow among zones, prevent water coning 124 or gas coning 126, etc.), increasing resistance to flow if a fluid viscosity or density decreases below a selected level (e.g., to thereby restrict flow of an undesired fluid, such as water or gas, in an oil producing well), and/or increasing resistance to flow if a fluid viscosity or density increases above a selected level (e.g., to thereby minimize injection of water in a steam injection well).

Figure 2:
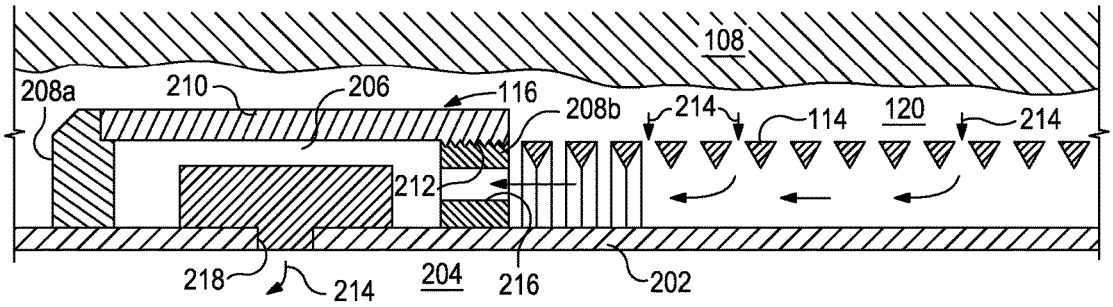
FIG. 2 illustrates an enlarged cross-sectional view of a flow control device and a portion of a well screen of FIG. 1, according to one or more embodiments.

Referring now to FIG. 2, with continued reference to FIG. 1, illustrated is an enlarged cross-sectional view of one of the flow control devices 116 and a portion of one of the well screens 114, according to one or more embodiments. As illustrated, the flow control device 116 and the well screen 114 may be operably coupled to or otherwise generally arranged about a base pipe 202 having an interior 204. The base pipe 202 may be or otherwise form part of the production tubing 112 of FIG. 1. The flow control device 116 may be arranged within a fluid compartment 206 generally defined by a first end ring 208*a*, a second end ring 208*b*, a sleeve 210, and the base pipe 202. The well screen 114 may be coupled to or otherwise attached to the second end ring 208*b* and extend axially therefrom about the exterior of the base pipe 202. While only one flow control device 116 is shown in FIG. 2, those skilled in the art will readily recognize that the flow control device 116 may form part of a system or assembly of several flow control devices arranged about the circumference of the base pipe 202 and otherwise within corresponding fluid compartments 206.

In at least one embodiment, the sleeve 210 may extend between the first and second end rings 208*a,b* and generally provide a cover for the fluid compartment 210. The sleeve 210 may be coupled to at least one of the end rings 208*a,b* in a variety of ways. For instance, in some embodiments, the sleeve 210 may be mechanically-fastened to at least one of the first and second end rings 208*a,b* using one or more mechanical fasteners (not shown). In other embodiments, as illustrated, the sleeve 210 may be threaded or threadably attached to at least one of the end rings 208*a,b*. For example, the second end ring 208*b* may define or otherwise provide a series of threads 212 configured to mate with corresponding threads defined on the sleeve 210.

In order to expose the fluid compartment 206, the sleeve 210 may be decoupled or otherwise unthreaded from one or both of the first and second end rings 208*a,b* and then subsequently removed in an axial direction with respect to the end rings 208*a,b*. As will be appreciated, exposing the fluid compartment 206 prior to deploying the flow control device 116 (and its associated system or assembly) downhole may prove advantageous in the event a well operator desires to make one or more on-site fluid flow adjustments or modifications to the flow control device 116, as will be described below. For instance, the flow control device 116 (and its associated system or assembly) may arrive at a well site with a particular manufacturer design applied thereto. According to the present disclosure, the well operator may be able to access the flow control device(s) 116 via at least the sleeve 210 in order to make certain adjustments thereto prior to downhole deployment, and thereby undertake on-site field adjustments to the amount of fluid being introduced into the base pipe 202 during operation.

In exemplary operation, a fluid 214 from the annulus 120 may be drawn through the well screen 114 and is thereby filtered before flowing into a flow port or conduit 216 defined in the second end ring 208*b*. The conduit 216 may extend through the second end ring 208*b* and thereby place the fluid compartment 206 in fluid communication with the annulus 120 via the well screen 114. The fluid 214 may be a fluid composition originating from the surrounding formation 108 and may include one or more fluid components, such as oil and water, oil and gas, gas and water, oil, water and gas, etc. Once in the fluid compartment 206, the fluid 214 may enter the flow control device 116 and eventually be discharged therefrom and into the interior 210 of the base pipe 202 via one or more flow ports 218 (one shown) defined in the base pipe 202.

In some embodiments, the flow control device 116 may be shrink-fitted into a corresponding flow port 218 and thereby secure the flow control device 116 therein for long-term operation. In at least one embodiment, the flow control device 116 may be an autonomous flow control device that is designed and otherwise configured to resist the flow of the fluid 214 therethrough based on one or more characteristics of the fluid 214, such as the density, the viscosity, or the velocity of the fluid 214 or its various fluid components.

Figure 3:
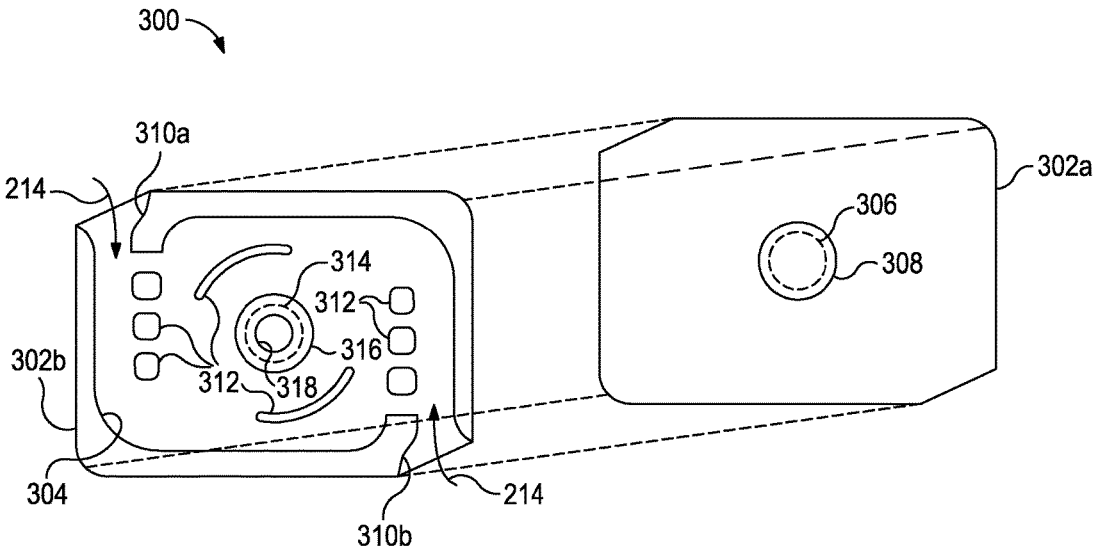
FIG. 3 illustrates an exploded top view of an exemplary autonomous inflow control device, according to one or more embodiments.

Referring now to FIG. 3, with continued reference to FIGS. 1 and 2, illustrated is an exploded top view of an exemplary autonomous inflow control device 300, according to one or more embodiments. The autonomous inflow control device 300 (hereafter "AICD 300") may be one of the flow control devices 116 of FIGS. 1 and 2. As illustrated, the AICD 300 may include a top plate 302*a* and a bottom plate 302*b*. The top plate 302*a* may be configured to be coupled to the bottom plate 302*b* in order to define a flow chamber 304 therebetween within the AICD 300. The top plate 302*a* may be coupled to the bottom plate 302*b* using a variety of techniques including, but not limited to, mechanical fasteners, adhesives, welding, brazing, heat shrinking, combinations thereof and the like. The AICD 300 may be made of, for example tungsten carbide, but may be made of any other materials known to those skilled in the art.

A hole 306 may be centrally-defined in the top plate 302*a* and may be configured to receive and secure a top plug 308 therein. As described in more detail below, the top plug 308 may be removable from the AICD 300 at a well site such that a well operator or rig hand may be able to access the interior of the AICD 300 and make one or more modifications to the AICD 300, if desired.

The bottom plate 302*b* may define one or more fluid inlets 310 (two shown as fluid inlets 310*a* and 310*b*) that provide fluid access into the flow chamber 304. While two fluid inlets 310*a,b* are depicted in FIG. 3, those skilled in the art will readily recognize that the AICD 300 is merely illustrative of one embodiment of the present disclosure. In other embodiments, an exemplary AICD may have only one fluid inlet or more than two fluid inlets, without departing from the scope of the disclosure. The fluid inlets 310*a,b* may be configured to receive the flow of fluid 214 derived from the annulus 120 (FIG. 2) as it flows into the fluid compartment 206 (FIG. 2).

The bottom plate 302*b* of the AICD 300 may further provide or otherwise define various internal structures 312 and an outlet 314. The outlet 314 may be centrally-located in the bottom plate 302*b* and may be in fluid communication with one of the flow ports 218 (FIG. 2) of the base pipe 202 (FIG. 2) and otherwise able to deliver the fluid into the base pipe 202. The internal structures 312 may be configured to induce spiraling of the flow of the fluid 214 about the outlet 314. As a result, the fluid 214 may be subjected to centrifugal or vortex forces that may create increased resistance to flow. As a result, the AICD 300 may provide a greater resistance to the flow of undesired fluids (e.g., water, gas, etc.) into the base pipe 202 than desired fluids (e.g., oils), particularly as the percentage of the undesired fluids increases.

In some embodiments, an exit nozzle 316 may be arranged or otherwise secured within the outlet 314 and configured to regulate the flow of fluids 214 out of the AICD 300 and into the base pipe 202 during operation. The exit nozzle 316 may provide or otherwise define a flow conduit 318 that fluidly communicates with the interior 204 (FIG. 2) of the base pipe 202. As will be appreciated, the size, length, and/or diameter of the flow conduit 318 may directly correspond to the potential flow rate of fluids therethrough. The exit nozzle 316 may be made of any material that is capable of withstanding erosion and/or corrosion. For instance, in some embodiments the exit nozzle 316 may be made of carbides (e.g., tungsten carbide) or ceramics. In other embodiments, the exit nozzle 316 may be coated with various materials such as, but not limited to, tungsten carbide and TEFLON®, without departing from the scope of the disclosure.

Figure 4:
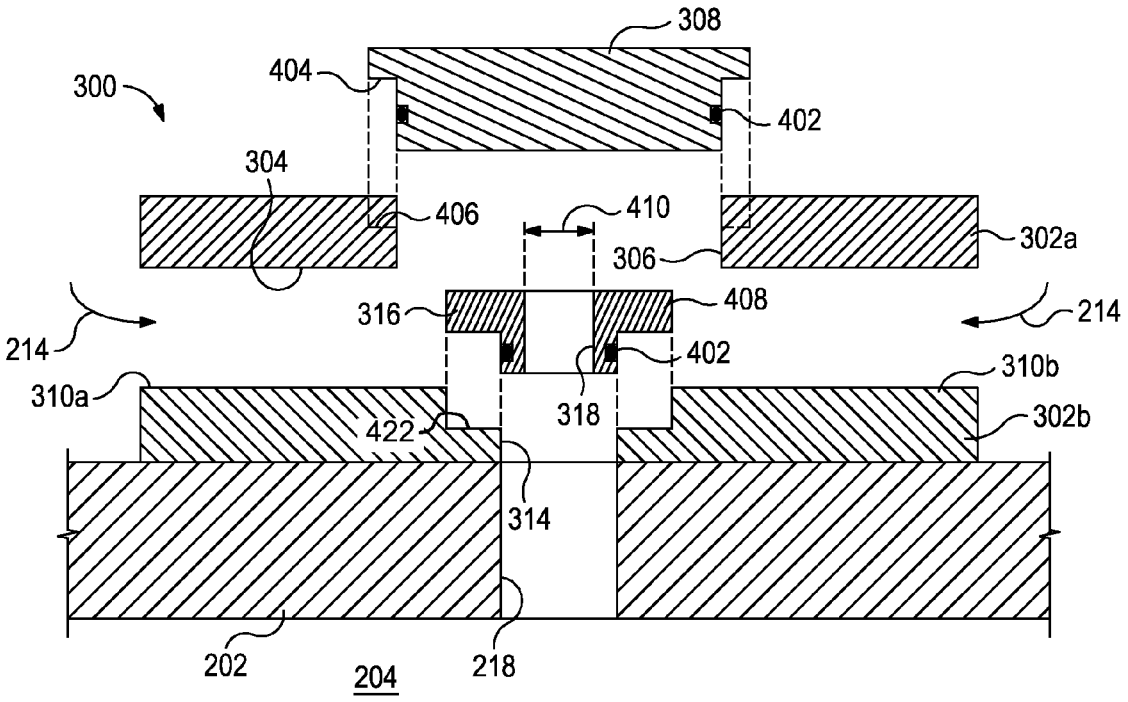
FIG. 4 illustrates an exploded cross-sectional view of an exemplary autonomous inflow control device, according to one or more embodiments.

Referring now to FIG. 4, illustrated is an exploded, cross-sectional side view of the AICD 300 of FIG. 3, according to one or more embodiments. As illustrated the AICD 300 is arranged on the base pipe 202 such that the outlet 314 is axially aligned with the flow port 218 of the base pipe 202, as generally described above. As is also illustrated, the top plug 308 is shown as being extendable within the hole 306 defined in the top plate 302*a*, and the exit nozzle 316 is shown as being extendable within the outlet 314 defined in the bottom plate 302*b*. Fluid 214 is able to flow into the flow chamber 304 via the fluid inlets 310*a* and 310*b*.

The top plug 308 may be removably secured within the hole 306 such that the top plug 308 may be removed in order to allow a well operator to access the exit nozzle 316 through the top plate 302*a*. In some embodiments, for example, the top plug 308 may be threaded into the hole 306 using corresponding mating threads (not shown) defined on opposing radial surfaces of each of the top plug 308 and the hole 306. In other embodiments, the top plug 308 may be mechanically-fastened into the hole 306 using to one or more mechanical fasteners (not shown), such as bolts, screws, snap rings, pins, a combination thereof, or the like.

The top plug 308 may further include one or more sealing elements 402 (one shown) arranged at the interface of the top plug 308 and the hole 306 in order to provide a sealed interface at that location. In some embodiments, the sealing element 402 may be an o-ring, or the like. In other embodiments, the sealing element 402 may be any other type of sealing device known to those skilled in the art that are able to withstand the pressures, temperatures, and corrosive environments of downhole applications.

In some embodiments, the top plug 308 may further define or otherwise provide an annular lip 404 that extends about the periphery of the top plug 308. In at least one embodiment, as illustrated, the annular lip 404 may be configured to be seated against the top surface of the top plate 302*a* when the top plug 308 is properly installed in the hole 306. In other embodiments, however, the annular lip 404 may be configured to be seated within a radial shoulder 406 (shown in phantom) defined within the top plate 302*a*. In either case, the bottom surface of the top plug 308 may be configured to seated substantially flush with the bottom surface of the top plate 302*a* when the top plug 308 is properly installed in the hole 306.

The exit nozzle 316 may be removably secured within the hole 306 such that an operator may remove the exit nozzle 316, if desired, and otherwise secure a different nozzle of a particular size or configuration within the hole 306 in order to regulate the flow of the fluid 214 therethrough and into the base pipe 202. In some embodiments, for example, the exit nozzle 316 may be threaded into the outlet 314 using corresponding mating threads (not shown) defined on opposing radial surfaces of each of the exit nozzle 316 and the outlet 314. In other embodiments, the exit nozzle 316 may be mechanically-fastened into the outlet 314 using to one or more mechanical fasteners (not shown), such as bolts, screws, snap rings, pins, a combination thereof, and the like.

Similar to the top plug 308, the exit nozzle 316 may further include one or more sealing elements 402 (one shown) arranged at the interface of the exit nozzle 316 and the outlet 314 in order to provide a sealed interface at that location. The exit nozzle 316 may also define or otherwise provide an annular lip 408 that extends about the periphery of the exit nozzle 316. In at least one embodiment, as illustrated, the annular lip 408 may be configured to be seated within a radial shoulder 422 defined within the bottom plate 302*b*. As such, the top surface of the exit nozzle 316 may be configured to seat substantially flush with the top surface of the bottom plate 302*b* when the exit nozzle 316 is properly installed in the outlet 314.

As mentioned above, the size, length, and/or diameter of the flow conduit 318 defined within the exit nozzle 316 may dictate the potential flow rate of the fluid 214 therethrough during operation. For instance, the flow conduit 318 for the exit nozzle 316 may exhibit a diameter 410 that allows a predetermined amount of fluid 214 therethrough. Other nozzles (not shown) that provide flow conduits exhibiting a different diameter or length may result in another predetermined amount of fluid 214 that is able to pass therethrough and into the base pipe 202. Accordingly, a well operator may selectively choose the size of the diameter 410 for each nozzle 316 in order to provide an AICD system with desired production capabilities.

Figure 4A:
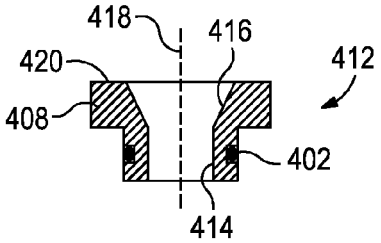
FIG. 4A illustrates a cross-sectional view of an exemplary exit nozzle, according to one or more embodiments.

Referring briefly to FIG. 4A, with continued reference to FIG. 4, illustrated is a cross-sectional view of another exemplary exit nozzle 412, according to one or more embodiments. The exit nozzle 412 may replace the exit nozzle 316 of FIG. 4 and otherwise provide a well operator with different flow characteristics for the fluid 214. Similar to the exit nozzle 316 of FIG. 4, the exit nozzle 412 may include the sealing element(s) 402 and the annular lip 408, as generally described above. The exit nozzle 412 of FIG. 4, however, may provide or define a tapered flow conduit 414. More particularly, the flow conduit 414 may provide a tapered surface 416 that tapers inward toward a central axis 418 from the top surface 420 towards the bottom of the exit nozzle 412. The tapered surface 216 of the exit nozzle 412 may prove advantageous during operation in order to get the flow of the fluid 214 (FIG. 4A) to spin faster. However, in some embodiments, the tapered diameter of the flow conduit 414 may be altered to control the total flow rate of the fluid 214 passing through the AICD 300, regardless of spinning or non-spinning behavior. Moreover, the exit nozzle 412 may be less susceptible to erosion because of its tapered geometry.

Referring again to FIG. 4, with dual reference to FIG. 2, according to the present disclosure, the exit nozzle 316 may be accessed by a well operator on-site and replaced with a different nozzle in order to adjust the potential flow rate of fluids 214 into the base pipe 202 for operation. In order to do this, the well operator may be able to access the AICD 300 by first removing the sleeve 210 and thereby exposing the fluid compartment 206. The operator may then be able to remove the top plug 308 from the hole 306 in the top plate 302*a* in order to access the exit nozzle 316. The exit nozzle 316 may then be replaced with a nozzle of a particular size or otherwise one that exhibits preferred flow characteristics (e.g., larger or smaller diameter 410). As will be appreciated, the size and/or diameter of the hole 306 may be at least slightly larger than the overall diameter and/or size of the exit nozzle 316, thereby allowing the well operator to detach and remove the exit nozzle 316 without significant obstruction caused by the hole 306 or the top plate 302*a* in general.

In at least one embodiment, however, the exit nozzle 316 may be removed and a plug (not shown) in the shape of a nozzle may instead be inserted into the outlet 314. The plug may substantially occlude the flow port 218 leading into the base pipe 202, and thereby prevent flow at that point. As can be appreciated, a well operator may be able to strategically place or replace nozzles (or plugs) for AICDs in an AICD system on-site in order to provide desired production needs and/or capabilities.

Figure 5A:
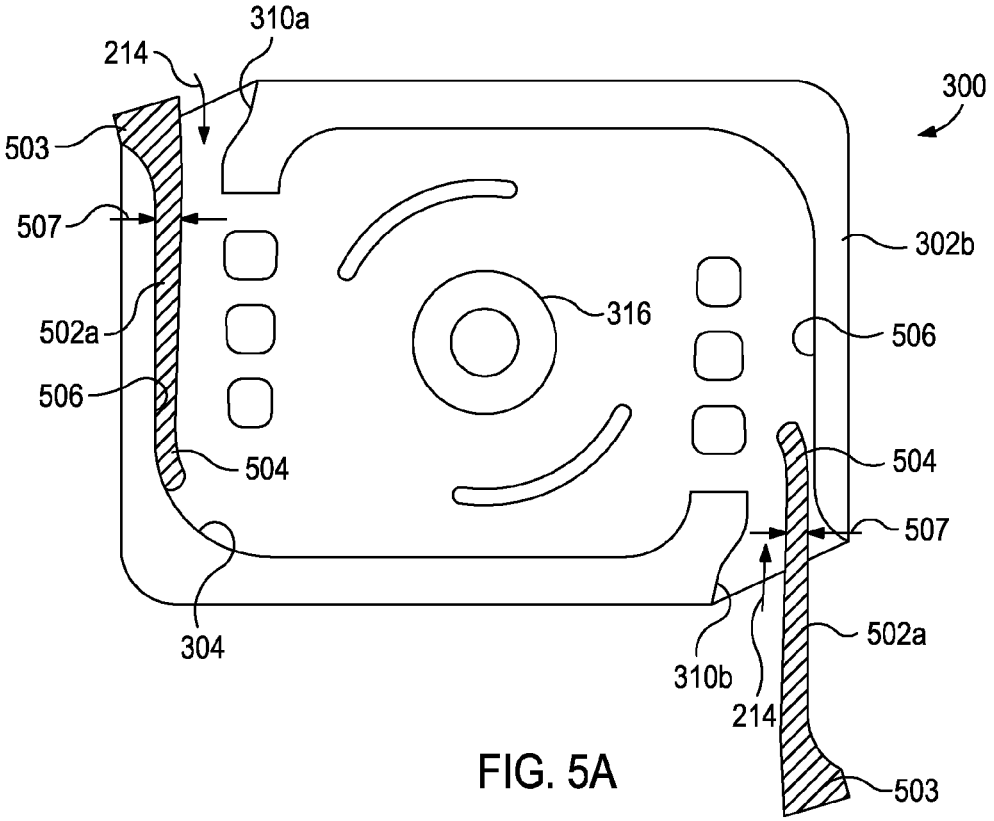
FIGS. 5A and 5B illustrate partial cross-sectional views of the AICD of FIG. 3 including one or more inlet flow restrictors, according to one or more embodiments.
Figure 5B:
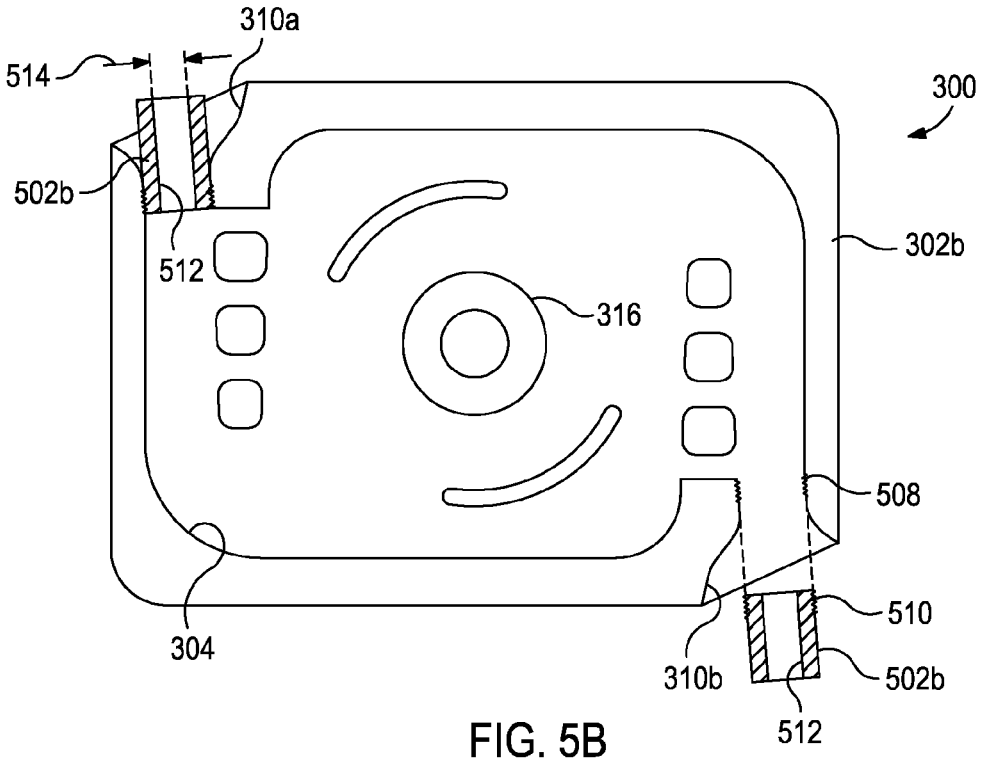

Referring now to FIGS. 5A and 5B, with reference again to FIG. 3, illustrated are partial cross-sectional views of the AICD 300 including one or more inlet flow restrictors, according to one or more embodiments. More particularly, FIG. 5A depicts a first type of inlet flow restrictor 502*a* and FIG. 5B depicts a second type of inlet flow restrictor 502*b*. As illustrated, each inlet flow restrictor 502*a,b* may be configured to be received within a corresponding one of the fluid inlets 310*a,b*. In exemplary operation, each inlet flow restrictor 502*a,b* may be configured to vary the flow rate of the fluid 214 into the flow chamber 304 of the AICD 300 via the corresponding fluid inlets 310*a,b*.

In FIG. 5A, one of the first inlet flow restrictors 502*a* is shown as being seated within the first fluid inlet 310*a* and the other first inlet flow restrictor 502*a* is shown in the process of being inserted into the second fluid inlet 310*b*. As illustrated, the first inlet flow restrictor 502*a* may have or otherwise define a head 503 and an elongate member 504 that extends from the head 503. The head 503 may be configured to engage the corresponding fluid inlet 310*a,b* and otherwise prevent the inlet flow restrictor 502*a* from being forced entirely into the flow chamber 304 during operation. To accomplish this, the head 503 may have at least a portion that extends out of the fluid inlet 310*a,b* and thereby serves as an anchor point for the first inlet flow restrictor 502*a*. The first inlet flow restrictor 502*a* may be configured to be secured within the fluid inlets 310*a,b* using an interference fit or heat shrinking between the top and bottom plates 302*a,b* of the AICD 300.

The elongate member 504 may be configured to seat against an inner wall 506 of the flow chamber 304 when properly installed within the AICD 300. In some embodiments, the elongate member 504 may be curved or otherwise strategically shaped in order to substantially match or mimic the curvature or shape of the inner wall 504 and thereby provide a more uniform seal or seat against the inner wall 504. The elongate member 504 may also exhibit a thickness 507 configured to restrict flow of the fluid 214 into the flow chamber 304. More particularly, a larger thickness 507 of the elongate member 504 may translate into less flow being allowed into the flow chamber 304 during operation. On the contrary, a smaller thickness 507 of the elongate member 504 may translate into more flow being allowed into the flow chamber 304 during operation. Accordingly, various sizes of the first inlet flow restrictor 502*a* may be manufactured and used by a well operator on-site to selectively adjust the flow of the fluid 214 into the AICD 300.

In FIG. 5B, one of the second inlet flow restrictors 502*b* is shown as being seated within the first fluid inlet 310*a* and the other second inlet flow restrictor 502*b* is shown in the process of being inserted into the second fluid inlet 310*b*. In some embodiments, the second inlet flow restrictors 502*b* may be threaded into the corresponding first and second fluid inlets 310*a,b*. More particularly, the second fluid inlet 310*b* is shown as having threads 508 defined on a portion thereof and configured to mate with corresponding threads 510 defined on the second inlet flow restrictor 502*b*. In other embodiments, however, the second inlet flow restrictors 502*b* may be inserted into the corresponding fluid inlets 310*a,b* and secured therein using an interference fit or heat shrinking techniques or processes.

Each second inlet flow restrictor 502*b* may include a central passageway 512 defined therethrough and exhibiting a predetermined diameter 514 (only one shown) that allows a predetermined amount of fluid 214 (FIG. 3) therethrough. Other nozzles (not shown) that provide flow conduits exhibiting a different diameter or length may result in another predetermined amount of fluid 214 that is able to pass therethrough and into the base pipe 202. Accordingly, a well operator may selectively choose the size of the diameter 410 for each second inlet flow restrictor 502*b* in order to provide an AICD system with desired production capabilities.

The inlet flow restrictors 502*a,b* may be inserted into the fluid inlets 310*a,b* of the AICD 300 by a well operator on-site in order to adjust the potential flow rate of fluids 214 into the base pipe 202 (FIGS. 2 and 3) for operation. In order to do this, the well operator may be able to access the AICD 300 by first removing the sleeve 210 (FIG. 2) and thereby exposing the fluid compartment 206 (FIG. 2). The operator may then be able to extend inlet flow restrictors 502*a,b* into one or both of the fluid inlets 310*a,b*, as generally described above.

In at least one embodiment, however, the inlet flow restrictor 502*a,b* may be a solid plug (not shown) or the like configured to substantially occlude the fluid inlets 310*a,b* and thereby prevent flow into the AICD 300 at that point. As can be appreciated, a well operator may be able to strategically place or replace the inlet flow restrictors 502*a,b* (or plugs) for AICDs in an AICD system on-site in order to provide desired production needs and/or capabilities.

Embodiments disclosed herein include:

A. A well system that may include a base pipe defining one or more flow ports and an interior, a first end ring and a second end ring each arranged about the base pipe, the second end ring being axially-offset from the first end ring such that a fluid compartment is defined therebetween, an autonomous inflow control device (AICD) arranged within the fluid compartment and having at least one fluid inlet and an outlet in fluid communication with the one or more flow ports, and a sleeve removably coupled to the first and second end rings and configured to be removed to provide access to the fluid compartment and the AICD in order to make on-site fluid flow adjustments to the AICD.

B. A method that includes receiving a well system including a base pipe defining one or more flow ports and an interior, the well system further including a first end ring and a second end ring each arranged about the base pipe, wherein the second end ring is axially-offset from the first end ring such that a fluid compartment is defined therebetween, removing a sleeve coupled to the first and second end rings and thereby exposing the fluid compartment, adjusting one or more fluid flow characteristics of an autonomous inflow control device (AICD) arranged within the fluid compartment, the AICD having at least one fluid inlet and an outlet in fluid communication with the one or more flow ports, and deploying the well system into a wellbore.

Each of embodiments A and B may have one or more of the following additional elements in any combination: Element 1: wherein the sleeve is at least one of mechanically-fastened and threaded to at least one of the first and second end rings. Element 2: wherein the AICD comprises a top plate, a bottom plate coupled to the top plate to define a flow chamber therebetween, and one or more internal structures configured to induce spiraling of a fluid about the outlet, the fluid being introduced into the flow chamber via the at least one fluid inlet. Element 3: wherein the AICD further comprises an exit nozzle arranged within the outlet and configured to restrict a flow of the fluid into the base pipe via the AICD, a hole defined in the top plate, and a top plug configured to be received within the hole in the top plate and removable from the hole in order to access the exit nozzle. Element 4: wherein the plug is at least one of threaded into the hole and mechanically-fastened to the hole. Element 5: wherein the exit nozzle is at least one of threaded into the outlet and mechanically-fastened to the outlet. Element 6: wherein the exit nozzle defines a flow conduit that fluidly communicates with the interior of the base pipe and exhibits a diameter corresponding to a predetermined flow rate of the fluid therethrough. Element 7: wherein the flow conduit is tapered. Element 8: wherein the exit nozzle is a plug that occludes the outlet and thereby prevents the flow of the fluid into the base pipe. Element 9: wherein the AICD further comprises an inlet flow restrictor secured within the at least one fluid inlet to restrict the flow of fluid into the flow chamber. Element 10: wherein the inlet flow restrictor comprises a head configured to engage the at least one fluid inlet, and an elongate member extending from the head and being configured to seat against an inner wall of the flow chamber. Element 11: wherein the inlet flow restrictor defines a central passageway having a predetermined diameter that allows a predetermined amount of the fluid to pass therethrough and into the flow chamber. Element 12: wherein the inlet flow restrictor is secured within the at least one fluid inlet using at least one of an interference fit, a heat shrinking process, one or more mechanical fasteners, and a threaded engagement. Element 13: wherein the inlet flow restrictor is a plug that prevents the flow of the fluid into the flow chamber via the at least one fluid inlet.

Element 14: wherein the AICD comprises a top plate, a bottom plate coupled to the top plate to define a flow chamber therebetween, and one or more internal structures configured to induce spiraling of a fluid about the outlet, the fluid being introduced into the flow chamber via the at least one fluid inlet, and wherein adjusting the one or more fluid flow characteristics of the AICD comprises removing a top plug received within a hole defined in the top plate and thereby providing access to the outlet of the AICD, and securing an exit nozzle in the outlet in order to restrict a flow rate of the fluid through the outlet and into the base pipe. Element 15: wherein securing the exit nozzle in the outlet comprises at least one of threading the exit nozzle into the outlet and mechanically fastening the exit nozzle in the outlet. Element 16: further comprising flowing the fluid through a flow conduit defined in the exit nozzle, the flow conduit fluidly communicating with the interior of the base pipe and exhibiting a diameter corresponding to a predetermined flow rate of the fluid therethrough. Element 17: wherein the exit nozzle is a plug and securing the exit nozzle in the outlet further comprises preventing the fluid from passing into the base pipe via the outlet. Element 18: wherein the exit nozzle is a second exit nozzle, the method further comprising removing a first exit nozzle from the outlet prior to securing the second exit nozzle in the outlet, wherein the first and second exit nozzle exhibit different flow characteristics. Element 19: wherein the AICD comprises a top plate, a bottom plate coupled to the top plate to define a flow chamber therebetween, and one or more internal structures configured to induce spiraling of a fluid about the outlet, the fluid being introduced into the flow chamber via the at least one fluid inlet, and wherein adjusting the one or more fluid flow characteristics of the AICD comprises securing an inlet flow restrictor within the at least one fluid inlet, and restricting a flow of fluid into the flow chamber with the inlet flow restrictor. Element 20: further comprising flowing the fluid through a central passageway defined in the inlet flow restrictor, the central passageway having a predetermined diameter that allows a predetermined amount of the fluid to pass therethrough and into the flow chamber. Element 21: wherein securing the inlet flow restrictor within the at least one fluid inlet comprises at least one of creating an interference fit, heat shrinking the inlet flow restrictor into the at least one fluid inlet, mechanically fastening the inlet flow restrictor to the at least one fluid inlet, and threading the inlet flow restrictor into the at least one fluid inlet. Element 22: wherein the inlet flow restrictor is a plug and restricting the flow of fluid into the flow chamber with the inlet flow restrictor comprises preventing the fluid from passing into the flow chamber with the inlet flow restrictor.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" does not require selection of at least one item; rather, the phrase allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A well system, comprising:

a base pipe defining one or more flow ports and an interior;

a first end ring and a second end ring each arranged about the base pipe, the second end ring being axially-offset from the first end ring such that a fluid compartment is defined therebetween;

an autonomous inflow control device (AICD) arranged within the fluid compartment and having:

at least one fluid inlet and an outlet in fluid communication with the one or more flow ports;

a flow chamber; and an inlet flow restrictor removably secured within the at least one fluid inlet to restrict a flow of fluid into the flow chamber, wherein the inlet flow restrictor is capable of being removed and replaced with another flow restrictor exhibiting different flow characteristics than the inlet flow restrictor; and a sleeve removably coupled to the first and second end rings and configured to be removed to provide access to the fluid compartment and the AICD in order to make on-site fluid flow adjustments to the AICD.

2. The well system of claim 1, wherein the sleeve is at least one of mechanically-fastened and threaded to at least one of the first and second end rings.

3. The well system of claim 1, wherein the AICD comprises:

a top plate;

a bottom plate coupled to the top plate to define the flow chamber therebetween; and one or more internal structures configured to induce spiraling of a fluid about the outlet, the fluid being introduced into the flow chamber via the at least one fluid inlet.

4. The well system of claim 3, wherein the AICD further comprises:

an exit nozzle arranged within the outlet and configured to restrict a flow of the fluid into the base pipe via the AICD;

a hole defined in the top plate; and a top plug configured to be received within the hole in the top plate and removable from the hole in order to access the exit nozzle.

5. The well system of claim 4, wherein the plug is at least one of threaded into the hole and mechanically-fastened to the hole.

6. The well system of claim 4, wherein the exit nozzle is at least one of threaded into the outlet and mechanically-fastened to the outlet.

7. The well system of claim 4, wherein the exit nozzle defines a flow conduit that fluidly communicates with the interior of the base pipe and exhibits a diameter corresponding to a predetermined flow rate of the fluid therethrough.

8. The well system of claim 7, wherein the flow conduit is tapered.

9. The well system of claim 4, wherein the exit nozzle is a plug that occludes the outlet and thereby prevents the flow of the fluid into the base pipe.

10. The well system of claim 1, wherein the inlet flow restrictor comprises:

a head configured to engage the at least one fluid inlet; and an elongate member extending from the head and being configured to seat against an inner wall of the flow chamber.

11. The well system of claim 1, wherein the inlet flow restrictor defines a central passageway having a predetermined diameter that allows a predetermined amount of the fluid to pass therethrough and into the flow chamber.

12. The well system of claim 1, wherein the inlet flow restrictor is secured within the at least one fluid inlet using at least one of an interference fit, a heat shrinking process, one or more mechanical fasteners, and a threaded engagement.

13. The well system of claim 1, wherein the inlet flow restrictor is a plug that prevents the flow of the fluid into the flow chamber via the at least one fluid inlet.

14. A method, comprising:

receiving a well system including a base pipe defining one or more flow ports and an interior, the well system further including a first end ring and a second end ring each arranged about the base pipe, wherein the second end ring is axially-offset from the first end ring such that a fluid compartment is defined therebetween;

removing a sleeve coupled to the first and second end rings and thereby exposing the fluid compartment;

adjusting one or more fluid flow characteristics of an autonomous inflow control device (AICD) arranged within the fluid compartment, the AICD having at least one fluid inlet and an outlet in fluid communication with the one or more flow ports, the adjusting comprising:

removing a first inlet flow restrictor from the at least one fluid inlet; and securing a second inlet flow restrictor in the at least one fluid inlet in order to restrict a flow rate of the fluid through the at least one fluid inlet into a flow chamber of the AICD, wherein the first inlet flow restrictor and the second inlet flow restrictor exhibit different flow characteristics; and deploying the well system into a wellbore.

15. The method of claim 14, wherein the AICD comprises a top plate, a bottom plate coupled to the top plate to define the flow chamber therebetween, and one or more internal structures configured to induce spiraling of a fluid about the outlet, the fluid being introduced into the flow chamber via the at least one fluid inlet, and wherein adjusting the one or more fluid flow characteristics of the AICD comprises:

removing a top plug received within a hole defined in the top plate and thereby providing access to the outlet of the AICD; and securing an exit nozzle in the outlet in order to restrict a flow rate of the fluid through the outlet and into the base pipe.

16. The method of claim 15, wherein securing the exit nozzle in the outlet comprises at least one of threading the exit nozzle into the outlet and mechanically fastening the exit nozzle in the outlet.

17. The method of claim 15, further comprising flowing the fluid through a flow conduit defined in the exit nozzle, the flow conduit fluidly communicating with the interior of the base pipe and exhibiting a diameter corresponding to a predetermined flow rate of the fluid therethrough.

18. The method of claim 15, wherein the exit nozzle is a plug and securing the exit nozzle in the outlet further comprises preventing the fluid from passing into the base pipe via the outlet.

19. The method of claim 15, wherein the exit nozzle is a second exit nozzle, the method further comprising removing a first exit nozzle from the outlet prior to securing the second exit nozzle in the outlet, wherein the first and second exit nozzle exhibit different flow characteristics.

20. The method of claim 14, wherein the AICD comprises a top plate, a bottom plate coupled to the top plate to define the flow chamber therebetween, and one or more internal structures configured to induce spiraling of a fluid about the outlet, the fluid being introduced into the flow chamber via the at least one fluid inlet.

21. The method of claim 20, further comprising flowing the fluid through a central passageway defined in the second inlet flow restrictor, the central passageway having a predetermined diameter that allows a predetermined amount of the fluid to pass therethrough and into the flow chamber.

22. The method of claim 20, wherein securing the second inlet flow restrictor within the at least one fluid inlet comprises at least one of creating an interference fit, heat shrinking the second inlet flow restrictor into the at least one fluid inlet, mechanically fastening the second inlet flow restrictor to the at least one fluid inlet, and threading the second inlet flow restrictor into the at least one fluid inlet.

23. The method system of claim 20, wherein the second inlet flow restrictor is a plug and restricting a flow of fluid into the flow chamber with the second inlet flow restrictor comprises preventing the fluid from passing into the flow chamber with the second inlet flow restrictor.

24. A method, comprising:

receiving a well system including a base pipe defining one or more flow ports and an interior, the well system further including a first end ring and a second end ring each arranged about the base pipe, wherein the second end ring is axially-offset from the first end ring such that a fluid compartment is defined therebetween;

removing a sleeve coupled to the first and second end rings and thereby exposing the fluid compartment;

adjusting one or more fluid flow characteristics of an autonomous inflow control device (AICD) arranged within the fluid compartment, the AICD having at least one fluid inlet and an outlet in fluid communication with the one or more flow ports, the adjusting comprising:

removing a first exit nozzle from the outlet; and securing a second exit nozzle in the outlet in order to restrict a flow rate of the fluid through the outlet and into the base pipe, wherein the first exit nozzle and the second exit nozzle exhibit different flow characteristics; and deploying the well system into a wellbore.

* * * * *